United States Patent [19]

Bronstein-Bonte et al.

[11] 4,124,388

[45] Nov. 7, 1978

[54] AMMONIUM MORDANTS FOR PHOTOGRAPHIC DYES

[75] Inventors: Irena Y. Bronstein-Bonte, Newton Center; Lloyd D. Taylor, Lexington, both of Mass.

[73] Assignee: Polaroid Corporation, Cambridge, Mass.

[21] Appl. No.: 793,061

[22] Filed: May 2, 1977

[51] Int. Cl.[2] ..... G03C 1/40; G03C 7/00; G03C 5/54

[52] U.S. Cl. ..... 96/29 D; 96/3; 96/77

[58] Field of Search ..... 96/3, 29 D, 77, 84 A, 96/114; 101/464

[56] References Cited

U.S. PATENT DOCUMENTS 3,239,337 3/1966 Haas ..... 96/29 D

*Primary Examiner*—Richard L. Schilling

[57] ABSTRACT

Photographic film units and photographic products using an acetal of a hydroxylated polymer and a formyl benzyl quaternary salt(s) as a mordant for diffusible dye image-providing materials.

48 Claims, 3 Drawing Figures

AMMONIUM MORDANTS FOR PHOTOGRAPHIC DYES

BACKGROUND OF THE INVENTION

1. The Field of the Invention

This invention relates to photographic products and processes and particularly to image-receiving layers used in diffusion transfer photographic products and processes.

2. Description of the Prior Art

Diffusion transfer photographic products and processes are known to the art and details relating to them can be found in U.S. Pat. Nos. 2,983,606; 3,345,163; 3,415,644; 3,415,645; 3,415,646; 3,473,925; 3,482,972; 3,551,406; 3,573,042; 3,573,043; 3,573,044; 3,576,625; 3,576,626; 3,578,540; 3,579,333; 3,3594,164; 3,594,165; 3,597,200; 3,647,437; 3,672,486; 3,705,184; 3,752,836; 3,857,855; 4,003,744 and British Pat. No. 1,330,524.

Essentially, diffusion transfer photographic products and processes involve film units having a photosensitive system including at least one selectively sensitized layer integrated with a dye image-providing material. After photoexposure, the photosensitive system is developed to establish a pattern of diffusible dye image-providing material and at least a portion of the image-providing material is transferred to an image-receiving element having an image-receiving layer comprising a material which can mordant or otherwise fix the diffusible dye. The image-receiving layer retains the diffusible dye for viewing and in some diffusion transfer products, the pattern is viewed in the layer after separation from the photosensitive system while in other products, such separation is not required.

Various polymeric materials have been employed to provide the image-receiving layers of diffusion transfer photographic products known to the art. Such materials include polymers which provide quaternary nitrogen groups and the use of these polymers in photographic products and/or processes are described in more detail in U.S. Pat. Nos. 3,239,337; 3,309,376; 3,698,896; 3,721,556; 3,756,814; 3,898,088; 3,958,995 and in German Offenlegungsschuft No. 2,450,662.

The present invention presents to the art, photographic products and processes providing improved performance characteristics because of the use of particular polymeric materials providing quaternary nitrogen groups as mordants for the diffusible dye image-providing materials.

SUMMARY OF THE INVENTION

Essentially, the improved photographic products and processes of the present invention comprise an acetal of a hydroxylated polymer and a formyl benzyl quaternary salt(s) as a mordant for the diffusible dye image-providing materials. The acetal mordants of this invention can be integrated with the photographic products in various ways. They can, for example, be included in the processing compositions so that upon distribution of the processing composition, the mordants are available for fixing or mordanting the diffusible dye. Alternatively — or additionally — the acetal mordants of this invention can comprise at least a part of the alkali and water permeable, usually substantially water insoluble image-receiving layer of the photographic products. In practice, photographic products and processes involving film units where the acetal mordant comprises at least part of the image-receiving layer material constitute the preferred embodiments of the invention. Particularly preferred image-receiving layers of this invention are those comprising an acetal of a hydroxylated polymer and a formyl benzyl quaternary salt of the following formula:

FORMULA A

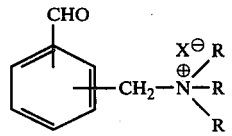

where each R can be the same or different aliphatic substituents but particularly preferred salts are those where R is an alkyl substituent having from 1–6 carbon atoms or carbocyclic, e.g., a cyclohexyl or a benzyl substituent and, X is an acid anion, preferably a halogen anion. Included are formyl benzyl quaternary salts where R is the same or different alkyl substituent having from 1–6 carbon atoms and at least one R is a carbocyclic substituent.

Acetals of hydroxylated polymers and formyl benzyl quaternary salts of the above formula can be prepared by known methods involving reacting a hydroxylated polymer, e.g., gelatins, celluloses, polyvinyl alcohols, etc. with the quaternary salts(s) to provide partial acetals of the hydroxylated polymeric material and the formyl benzyl quaternary salt. Accordingly, illustrative acetals of hydroxylated polymers used in the image-receiving layers of the photographic products of this invention contain segments illustrated by the following formulae:

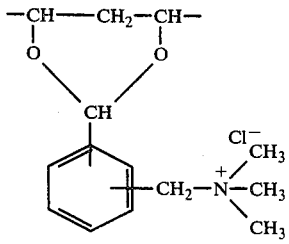

-continued

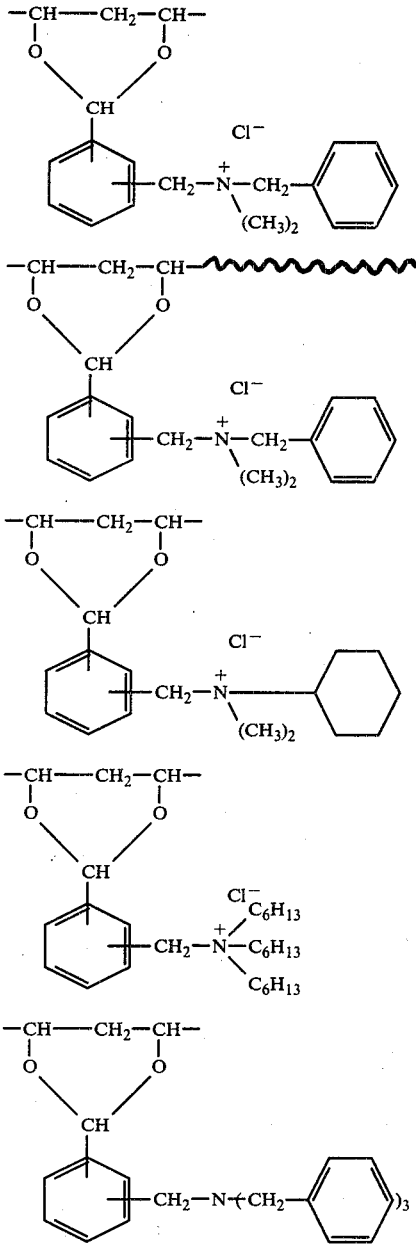

The invention as well as details relating to how to make and use it will be better appreciated by reference to the following description of the preferred embodiments taken in connection with the accompanying drawings.

DESCRIPTION OF THE PREFERRED EMBODIMENTS

The Preferred Image-Receiving Layers

The preferred image-receiving layers of this invention comprise a partial acetal of polyvinyl alcohol and a benzaldehyde quaternary salt of Formula A as the image-receiving layer material and the amount of partial acetal used as the image-receiving layer forming material can vary from about 10% by weight of acetal to 100%. Particularly preferred are those image-receiving layers which comprise a blend or mixture of a partial acetal of polyvinyl alcohol and the benzaldehyde quaternary salt with other known polymeric image-receiving layer materials particularly hydrophilic polymeric materials such as gelatin, polyvinyl alcohols, polyvinyl pyridines, etc. and mixtures of these. For example, image-receiving layers having especially desirable performance characteristics are those which comprise between about 40 to about 60% by weight of the partial acetal blended with polyvinyl alcohol. Partial acetals suitable for preparing the preferred image-receiving layers of this invention are those having a degree of acetalization between about 5 to about 40%; that is to say, partial acetals having between about 5 to about 40% molar substitution of the acetal mordant on the polyvinyl alcohol backbone.

The Preferred Film Units of the Invention

The particularly preferred film units of the present invention are integral negative-positive film units of the type described in detail in referenced U.S. Pat. Nos. 3,415,644 and 3,647,437.

Figure 1:
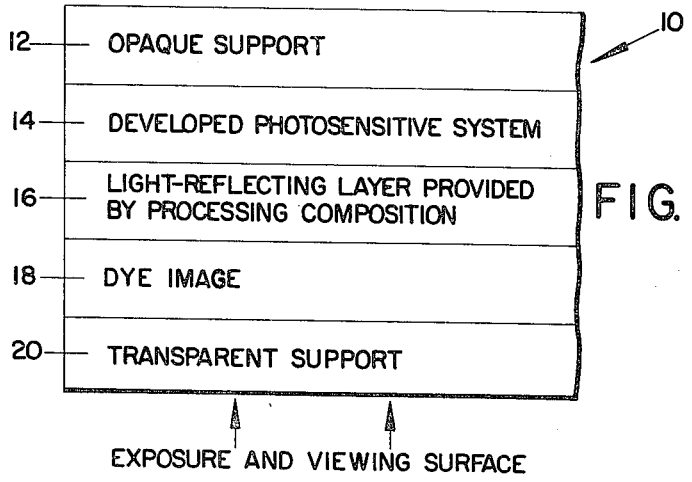
FIGS. 1–3 are simplified schematic views of arrangements of essential elements of preferred film units of the present invention, shown after exposure and processing.

A representative particularly preferred film unit is shown as 10 (FIG. 1) and includes a light-reflecting layer provided by a light-reflecting pigment in a processing composition initially present in a rupturable processing container (not shown) and distributed after photoexposure of photosensitive layer(s) 14 through transparent support 20 and image-receiving layer 18. Processing compositions used in such film units are aqueous alkaline photographic processing compositions comprising an opacifying system which include a titanium dioxide pigment as the light-reflecting agent, preferably in combination with an optical filter agent described in detail in U.S. Pat. No. 3,647,437. When the processing composition is distributed over all portions of photoexposed photosensitive system 14, a light-reflecting layer 16 comprising the titanium dioxide is provided between image-receiving layer 18 and photosensitive layer 14. Application of the processing composition initiates developing of photoexposed photosensitive layer(s) 14 in manners well known to the art to establish an imagewise distribution of diffusible image-providing material which can comprise silver but preferably comprises one or more dye image-providing material. The diffusible image-providing material(s) is transferred through permeable, light-reflecting titanium dioxide-containing layer 16 where it is mordanted, precipitated or otherwise retained in known manner in image-receiving layer 18. The transfer image is viewed through transparent support 20 against light-reflecting layer 16.

Figure 2:
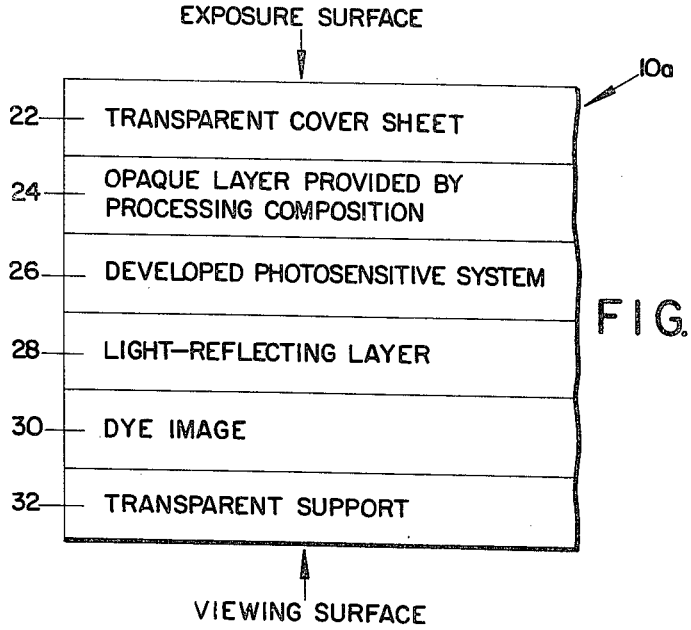

FIG. 2 shows an arrangement of essential elements of an integral negative-positive film unit of the type described in referenced U.S. Pat. No. 3,594,165 and British Pat. No. 1,330,524 following exposure and processing. The film unit 10*a* includes a processing composition initially retained in a rupturable container (not shown) and distributed between cover sheet 22 and photosensitive system or layer 26 after photoexposure of photosensitive element(s) 26 through transparent cover sheet 22. Processing compositions used in such film units are aqueous alkaline photographic processing compositions which include an opacifying system comprising an opaque pigment which need not be — and usually is not — light reflecting. After distribution of the processing composition between transparent cover sheet 22 and photoexposed photosensitive layer 26, opaque layer 24 is installed to protect layer 26 from further photoexposure through cover sheet 22. Like the film units of FIG. 1, as and after opaque layer 24 is installed, the processing composition initiates developing of photoexposed photosensitive layer 26 to establish an imagewise distribution of the image-providing materials in manners well known to the art. For example, the processing composition alone may cause development or developing agents may be in the processing composition initially and/or the agents may be in the film unit so that they may be carried to layer 26 by the processing composition. The imagewise distribution is transferred through permeable titanium dioxide containing reflecting layer 28 to dye image element 30 for viewing through transparent support 32 against the titanium dioxide containing layer 28.

Figure 3:
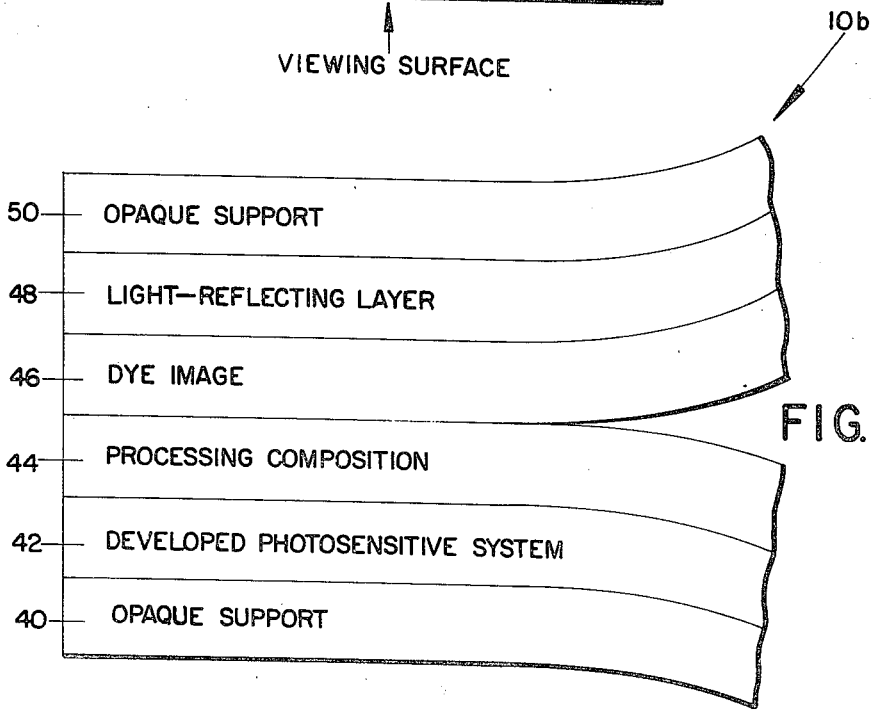

The novel image-receiving layers of the present invention also may be utilized in film units designed to be separated after processing. Such a diffussion transfer film unit of the present invention is shown in FIG. 3 as 10*b*. The film unit shown there comprises a photosensitive element having an opaque support 40 carrying a photosensitive system containing layer(s) 42. In film units of this type the photosensitive element is photoexposed and a processing composition 44 is then distributed over the photoexposed system and an image-receiving element comprising dye image layer 46 carried by support 50 — preferably opaque — is superposed on the photoexposed photosensitive element. Like the film units of FIGS. 1 and 2, the processing composition permeates layer(s) 42 to provide an imagewise distribution of diffusible dye image-providing materials which is transferred to dye image layer 46. Unlike the film units of FIGS. 1 and 2, however, the transferred dye image is viewed in layer 46 against light-reflecting background 48 after separation of the image-receiving element from the photosensitive element.

THE PREPARATION OF THE PREFERRED FORMYL BENZYL QUATERNARY SALTS

Essentially, compounds of Formula A can be prepared according to the following illustrative reaction scheme:

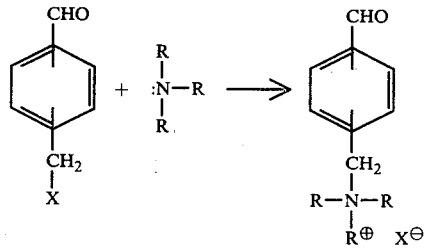

FORMULA A where R and X are as defined before.

A particularly preferred compound of Formula A is the formyl benzyl quaternary salt of the following formula:

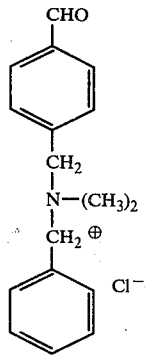

FORMULA B

N(p-formyl benzyl) N-benzyl-NN-dimethyl ammonium chloride

Example 1 relates to a preparation of the quaternary salt of Formual B and the illustrative preparation involves the following reaction scheme:

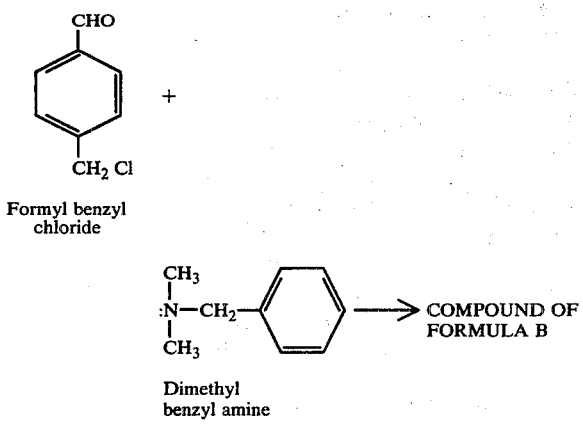

EXAMPLE 1

The following materials were added to a roundbottom flask equipped with a drying tube and magnetic stirrer:

| | | | |
|---|---|---|---|
| N,N dimethyl benzyl amine | 13.5 | gms. | (0.1M) |
| Benzene | 40 | mls. | |
| Acetonitrile | 10 | mls. | |

Then, 15.5 gms. of formyl benzyl chloride were added to the stirred mixture and the mixture (solution) was stirred overnight. The resulting N(p-formyl benzyl) N-benzyl, N,N dimethyl ammonium chloride (mp 175°–178° C.) was recrystallized from acetone.

EXAMPLE 2

This Example illustrates a preparation of a partial acetal of polyvinyl alcohol with the quaternary salt of Example 1. The illustrative preparation involves the following reaction scheme:

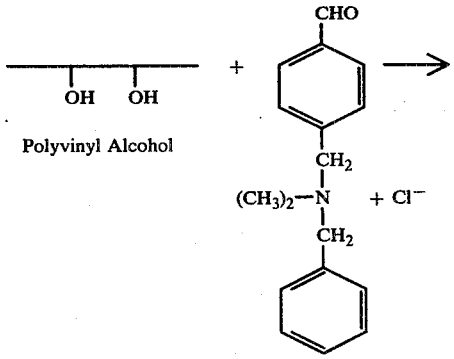

-continued

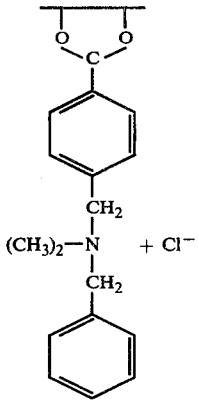

8.8 gms. of polyvinyl alcohol (Elvanol 90/50 G[1]) (0.2 M) were added to 100 mls. of $H_2O$ in a 250 mls., 3-neck round-bottom flask equipped with an overhead stirrer and condenser. Then, the mixture was stirred and heated on a steam bath to dissolve the polyvinyl alcohol. The colorless solution was then cooled to room temperature and 5.78 gms. of N(p-formyl benzyl), N-benzyl, N,N-dimethyl ammonium chloride (0.02 M) and 1 ml. 96% $H_2SO_4$ (catalyst) were added to the solution. The solution was stirred overnight and then neutralized with KOH and the polymer solution was precipitated by pouring it into acetone. The acetal was washed three times with acetone and then dissolved in 300 mls. $H_2O$ and dialyzed overnight. The dialyzed solution was placed in a Virtis flask and lyophilized. Yield of product was 11 gms. of the acetal of polyvinyl alcohol and N(p-formyl benzyl) N-benzyl, N,N-dimethyl ammonium chloride having a degree of acetalization of about 9.3%.

1. Elvanol 90/50 G is a polyvinyl alcohol sold by E. I. DuPont de Nemours & Co., Inc.

EXAMPLE 3

The procedure of Example 2 was repeated but 8.73 gms. of N(p-formyl benzyl) N-benzyl, N,N-dimethyl ammonium chloride were used rather than the 5.78 gms. N(p-formyl benzyl) N-benzyl, N,N-dimethyl ammonium chloride of Example 2. The product obtained in this Example was the acetal of polyvinyl alcohol and N(p-formyl benzyl) N-benzyl, N,N-dimethyl ammonium chloride having a degree of acetalization of about 15%.

EXAMPLE 4

The procedure of Example 3 was repeated but only 4.4 gms. of polyvinyl alcohol were used rather than the 8.8 gms. used in Example 3. The product obtained in this Example was the acetal of polyvinyl alcohol and N(p-formyl benzyl) N-benzyl, N,N-dimethyl ammonium chloride having a degree of acetalization of about 30%.

EXAMPLE 5

8.8 g. (0.2 mole) polyvinyl alcohol (Elvanol 90/50 G) were added to 100 ml. $H_2O$ in a 3-neck flask equipped with a mechanical stirrer and condenser. The mixture was heated on a steam bath to dissolve the polyvinyl alcohol. After cooling the solution to room temperature, 12.78 g. (0.06 mole) of p-formyl benzyl N,N,N,trimethyl ammonium chloride were added with 1 ml. 96% $H_2SO_4$. The solution was stirred overnight and then neutralized with KOH and the polymer was precipitated by pouring it into acetone. The acetal was washed three times, then dissolved in 300 mls. $H_2O$ and lyophilized. Yield of product was 12 g. of the acetal of polyvinyl alcohol and p-formyl benzyl N,N,N,trimethyl ammonium chloride having a degree of acetalization of about 30%.

EXAMPLE 6

8.8 g. (0.2 mole) polyvinyl alcohol (Elvanol 90/50 G) were added to 100 mls. $H_2O$ in a 3-neck flask equipped with a mechanical stirrer and condenser. The mixture was heated on a steam bath to dissolve the polyvinyl alcohol. After cooling the solution to room temperature, 8.73 g. (0.03 mole) of p-formyl benzyl N benzyl, N,N-dimethyl ammonium chloride and 6.3 g. (0.03 mole) p-formyl benzyl N,N,N,trimethyl ammonium chloride plus 1 ml. 96% $H_2SO_4$ were added to the solution. The solution was stirred overnight, then washed, precipitated and lyophilized as in the above Examples. Yield of product was 12 g. of the acetal of polyvinyl alcohol and (p-formyl benzyl) N-benzyl, N,N-dimethyl ammonium chloride and (p-formyl benzyl) N,N,N,trimethyl ammonium chloride. The total degree of acetalization of the acetal was about 30% with a degree of acetalization of the (p-formyl benzyl) N-benzyl, N,N-dimethyl ammonium chloride of about 15% and a degree of acetalization of the (p-formyl benzyl) N,N,N,trimethyl ammonium chloride of about 15%.

The unexpected advantages obtained by using the novel image-receiving layers of the present invention are illustrated by way of the following Examples:

For the following Examples, a series of film units (of the type shown in FIG. 1) were prepared as follows:

The photosensitive elements were prepared by coating a gelatin subcoated 4 mil, opaque polyethylene terephthalate film base with the following layers:

1. a layer comprising the cyan dye developer:

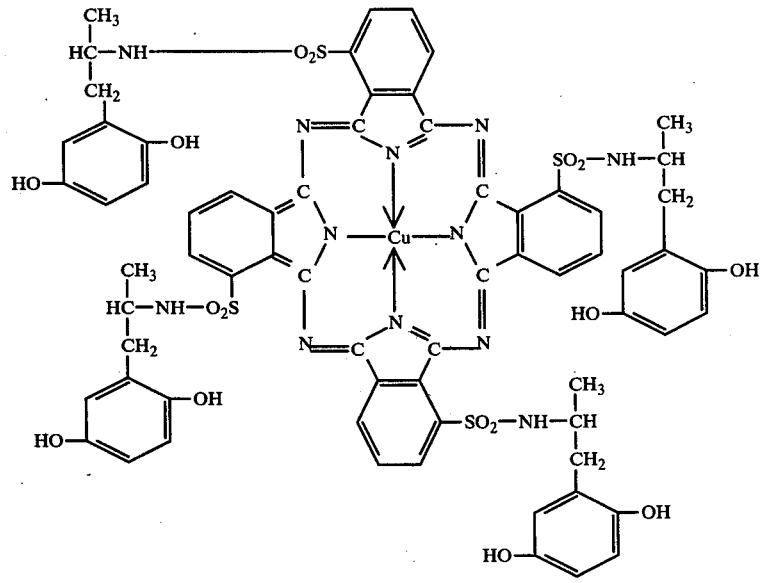

dispersed in gelatin and coated at a coverage of about 75.1 mgs./ft$^2$ of dye;

2. a red-sensitive gelatino silver iodobromide emulsion layer;
3. a spacer layer;
4. a layer comprising the magenta dye developer:

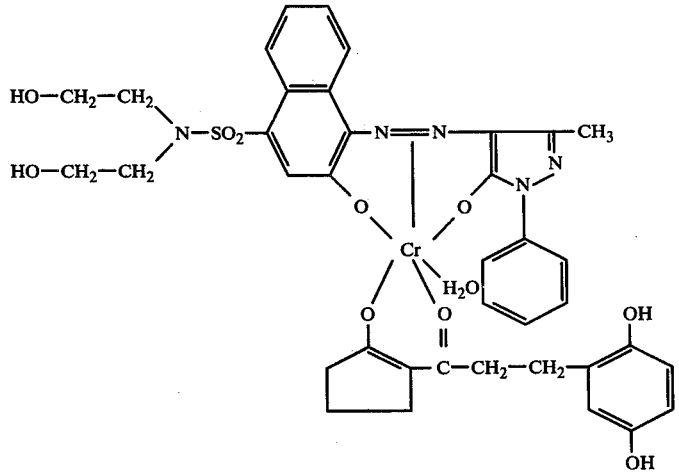

dispersed in gelatin and coated at a coverage of about 60 mgs./ft.$^2$;

5. a green-sensitive gelatino silver iodobromide emulsion layer;

6. a spacer layer;

7. a layer comprising the yellow dye developer:

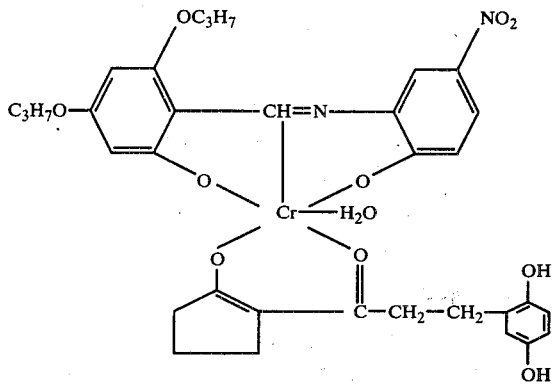

dispersed in gelatin and coated at a coverage of about 84 mgs/ft.$^2$ of dye;

8. A blue-sensitive gelatino silver iodobromide emulsion layer;

9. a layer of carbon black dispersed in gelatin coated at a coverage providing about 4 mgs./ft.$^2$ of carbon.

The image-receiving elements were prepared by coating a transparent 4 mil polyethylene terephthalate film base with the following layers to form an image-receiving component: 1. as a polymeric acid layer, the partial butyl ester of polyethylene/maleic anhydride copolymer mixed with about 10% by weight of polyvinyl butyrol and coated at a coverage of about 2,500 mgs./ft.$^2$;

2. a timing layer containing about a 4:1 ratio of a 6-30-4-6 tetrapolymer of butylacrylate, diacetone acrylamide, styrene and methacrylic acid and polyvinyl alcohol at a coverage of about 500 mgs./ft.$^2$; and 3. a polymeric image-receiving layer containing polymeric materials described in detail in the Examples which follow at a coverage of about 300 mgs./ft.$^2$.

The so prepared image-receiving and photosensitive elements can be taped together in laminate form, at their respective edges, by means of pressure-sensitive binding members (tapes) extending around, in contact with and over the edges of the resulting laminate. The preferred binding members are opaque so as to prevent edge leakage of light.

A rupturable container retaining an aqueous alkaline processing composition may then be fixedly mounted on the leading edge of each of the laminates, by pressure-sensitive tapes interconnecting the respective containers and laminates, so that, pressure applied to the container would rupture the container's marginal seal and its contents could be distributed between the image-receiving layer and the carbon-containing gelatin layer of the photosensitive element.

In each of the film units of the Examples, the aqueous processing composition comprised:

| | |
|---|---|
| Water | 100 cc |
| Potassium hydroxide (45%) | 25.9 g. |
| N-benzyl-α-picolinium bromide (50% solution in water) | 5.8 g. |
| Carboxymethyl hydroxymethyl cellulose (Hercules Type 420H) | 4.8 g. |

-continued

| | |
|---|---|
| Titanium dioxide | 59.5 g. |
| 6-methyl uracil | 0.5 g. |
| bis-(β-aminoethyl)-sulfide | 0.05 g. |
| Benzotriazole | 1.8 g. |
| Colloidal silica aqueous dispersion (30% $SiO_2$) | 2 g. |
| N-2-hydroxyethyl-N,N', N'-tris-carboxymethyl-ethylene diamine | 1.9 g. |
| Polyethylene glycol (molecular weight 6,000) | 0.5 g. |
| 4-amino pyrazolo pyrimidine | 9.5 g. |
| 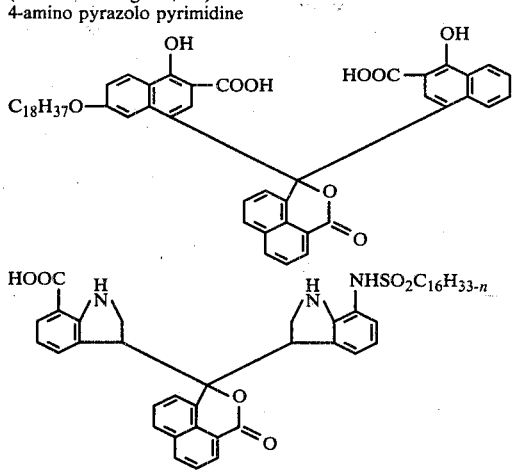 | 3.3 g. |
| | 0.7 g. |

The photosensitive element of so prepared integral negative-positive film units may be exposed through the transparent support and a layer of the processing composition may be distributed by passing the film unit between a pair of pressure-applying rolls.

EXAMPLE 7

In this Example, density measurements of an exposed and processed film unit prepared as described and having an image-receiving layer comprising an acetal of the prior art are compared with density measurements of a series of film units having image-receiving layers comprising the acetals of this invention. In the following Tables 1 and 2, the film unit designated as "SC-6832" had an image-receiving layer comprising an acetal of the type described in U.S. Pat. No. 3,239,337. Specifically, the acetal employed was a partial acetal of polyvinyl alcohol having a degree of acetalization of about 34.2% and containing segments illustrated by the following general formula:

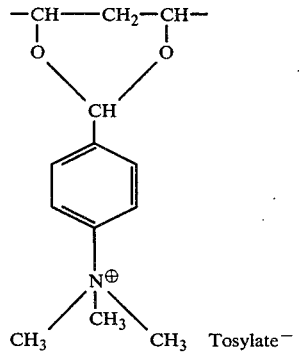

The acetal of polyvinyl alcohol and N-(formylphenyl) N,N,N-trimethyl ammonium p-toluene sulfonate.

FORMULA C

All other film units in Tables 1 and 2 had image-receiving layers comprising a partial acetal of polyvinyl alcohol of this invention which contained segments illustrated by the following formula:

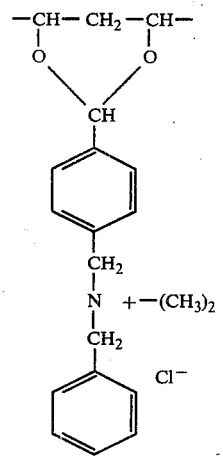

The acetal of polyvinyl alcohol and N(p-formyl benzyl) N-benzyl,N,N-dimethyl ammonium chloride.

FORMULA D

The film units of this Example and the degree of acetalization of the partial acetals used as the image-receiving layer material are described in detail in the following Table 1.

TABLE 1

| FILM UNIT | DEGREE OF ACETALIZATION | PERCENT PARTIAL ACETAL IN IMAGE-RECEIVING LAYER |
|---|---|---|
| SC6832 | 34.2 % | 100% |
| SC6843 | 5 % | 100% |
| SC6600 | 10 % | 100% |
| SC6721 | 15 % | 100% |
| SC6811 | 20 % | 100% |
| SC6804 | 30 % | 100% |

Each of the film units of Table 1 were exposed to a multicolor strip wedge and then processed at room temperature. After processing was complete the maximum densities were measured for the various colors with a Quantalog MacBeth Densitometer. Table 2 presents the results of these measurements.

TABLE 2

| FILM UNIT | D-MAX | | |
|---|---|---|---|
| | RED | GREEN | BLUE |
| SC6832 | 2.02 | 1.50 | 1.74 |
| SC6843 | 2.14 | 1.75 | 1.74 |
| SC6600 | 1.94 | 1.74 | 1.78 |
| SC6721 | .83 | 1.59 | 1.72 |
| SC6811 | .81 | 1.51 | 1.67 |
| SC6804 | .57 | .99 | 1.02 |

A comparison of the D-max measurements of Table 2 reveals interesting differences between the acetals of the prior art (Film Unit SC6832) and those of the present invention. Film Unit SC6832 has a desirably high Red D-max coupled with an acceptable Blue D-max but the Green D-max is undesirably low. However, as shown in Table 2, Film Units SC6843 and SC6600 have high Red-D-max values as well as acceptable Blue and Green D-max values providing images of high color densities as well as a better balance of color densities. Moreover, these improvements are obtained with acetals of this invention which have a 5% degree of acetalization (Film Unit SC6843) and a 10% degree of acetalization (Film Unit SC6600) as opposed to a 30% degree of acetalization for the acetal of the prior art (Film Unit SC6832).

Even more interesting is the significant drop in D-max, especially in the Red D-max, encountered in film units having image-receiving layers comprising acetals of this invention having a degree of acetalization greater than about 15% (Film Units SC6721, SC6811 and SC6804). Such performance characteristics would tend to suggest that employment of acetals of Formula D having degrees of acetalization greater than about 15% would not be desirable. However, the following example clearly establishes that acetals of Formula D and having degree of acetalization greater than about 15% can provide image-receiving layers of desirable performance characteristics.

EXAMPLE 8

In this Example, density measurements of a film unit having an image-receiving layer comprising a 1:1 mixture of polyvinyl alcohol and a partial acetal of polyvinyl alcohol of the prior art are compared with density measurements of a series of density measurements of film units having image-receiving elements comprising a 1:1 mixture of polyvinyl alcohol and the partial acetals of this invention. In the following Tables 3 and 4, the image-receiving layer of the film unit designated as SC6833 consisted of a 1:1 mixture of polyvinyl alcohol and the acetal of polyvinyl alcohol and N(p-formyl benzyl) N,N,N-trimethyl ammonium p toluene sulfonate (Formula C). All other film units of Tables 3 and 4 had image-receiving layers consisting of a 1:1 mixture of polyvinyl alcohol and the partial acetal of polyvinyl alcohol and N(p-formyl benzyl)N,benzyl, N,N,-dimethyl ammonium chloride (Formula D). Table 3 below describes the film units more fully.

TABLE 3

| FILM UNIT | DEGREE OF ACETALIZATION | PERCENT PARTIAL ACETAL IN IMAGE-RECEIVING LAYER |
|---|---|---|
| SC6833 (Prior Art) | 34.2 % | 50% |
| SC6650 | 5 % | 50% |
| SC6601 | 10 % | 50% |
| SC6720 | 15 % | 50% |
| SC6709 | 20 % | 50% |
| SC6809 | 30 % | 50% |

In this and all other Examples, the polyvinyl alcohol mixed with the acetal was Gelvatol 1-90, a polyvinyl alcohol sold by Monsanto Chemical Company.

The film units were exposed and processed as before and maximum densities measured as in Example 1. Table 4 presents the results of the measurements.

TABLE 4

| FILM UNIT | D-MAX | | |
|---|---|---|---|
| | RED | GREEN | BLUE |
| SC6833 (Prior Art) | 2.44 | 1.54 | 1.58 |
| SC6650 | 1.90 | 1.53 | 1.54 |
| SC6601 | 2.08 | 1.73 | 1.74 |
| SC6720 | 2.33 | 1.80 | 1.88 |
| SC6709 | 2.54 | 1.97 | 2.06 |
| SC6809 | 2.49 | 1.94 | 1.98 |

The density measurements of Table 4 evidence other interesting properties of the acetals of this invention.

Film Unit SC6833 which has an image-receiving layer comprising a 1:1 mixture of polyvinyl alcohol and the acetal of the prior art provides a desirably high Red D-max but low Green and Blue D-max values thereby providing an undesirable balance between the color densities. However, Film Units SC6601, SC6720, SC6709 and SC6809 have image-receiving layers providing high Red D-max values coupled with increased Green and Blue D-max values providing images having a better balance of color densities.

A particularly interesting comparison can be made between Film Unit SC6809 of this Example and Film Unit SC6721 of Example 7. Both film units employ the same acetal of this invention but Film Unit SC6721 of Example 7 had an image-receiving layer where the image-receiving layer material comprised the acetal alone and the acetal had a percentage degree of acetalization of 15%. Film Unit SC6809 has an image-receiving layer comprising the same acetal having a degree of acetalization of about 30% but the acetal constitutes only 50% of the image-receiving layer material. Under such circumstances the degree of acetalization of the image-receiving layer material of the receiving layer of Film Unit SC6809 is also about 15%. However, Table 5 below evidences the startling difference in performance characteristics of the image-receiving layers of the film units.

TABLE 5

| FILM UNIT | D-MAX RED | D-MAX GREEN | D-MAX BLUE |
|---|---|---|---|
| SC6721 | .83 | 1.59 | 1.72 |
| SC6809 | 2.49 | 1.94 | 1.98 |

EXAMPLE 9

In this Example, density measurements of Film Unit SC6833 (Example 8) having an image-receiving layer comprising the prior art acetal are compared with density measurements of a film unit having an image-receiving layer comprising a 1:1 mixture of polyvinyl alcohol and another acetal of this invention. In Table 6 below, the film unit designated as Film Unit SC6862 had an image-receiving layer comprising a 1:1 mixture of polyvinyl alcohol and an acetal as prepared in Example 6, e.g., an acetal of polyvinyl alcohol and N(p-formyl benzyl) N,benzyl N,N-dimethyl ammonium chloride and N(p-formyl benzyl) N,N,N-trimethyl ammonium chloride. The degree of acetalization of N(p-formyl benzyl) N benzyl N,N-dimethyl ammonium chloride was about 15% while the degree of acetalization of N(p-formyl benzyl N,N,N-trimethyl ammonium chloride was also about 15%. Accordingly, the image-receiving layer of Film Unit SC6862 comprised the acetal containing segments illustrated by the following formula:

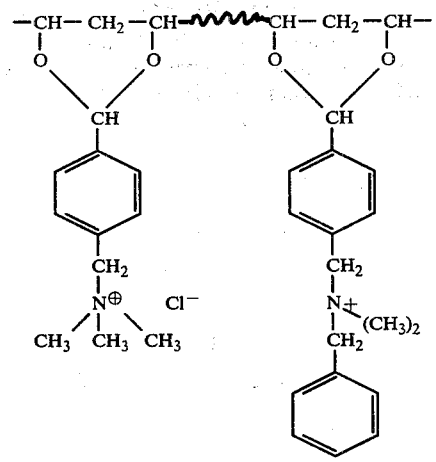

FORMULA E

Both film units were exposed, processed and density measurements were made as before. Table 6 presents the results of the density measurements.

TABLE 6

| FILM UNIT | D-MAX RED | D-MAX GREEN | D-MAX BLUE |
|---|---|---|---|
| SC6833 | 2.44 | 1.54 | 1.58 |
| SC6862 | 2.75 | 2.05 | 2.09 |

Again, a desirably high Red D-max value is obtained with the Film Unit SC6833) having the image-receiving layer comprising the acetal of the prior art but the Green and Blue D-max values are considerably lower. However, the image-receiving layer of Film Unit SC6862 provides D-max values which are significantly higher for the red as well as the green and blue colors.

EXAMPLE 10

In this Example, density measurements of the Film Unit SC6832 (Prior Art) (Example 7) are compared with density measurements of a film unit having an image-receiving layer comprising still another acetal of this invention. In the Table below, the film unit designated SC6846 had an image-receiving layer comprising an acetal prepared as in Example 6, e.g., an acetal of polyvinyl alcohol and N(p-formyl benzyl) N,N,N-trimethyl ammonium chloride (about 30% degree of acetalization). Accordingly, the acetal of the image-receiving layer of Film Unit SC6846 contained segments illustrated by the following formula:

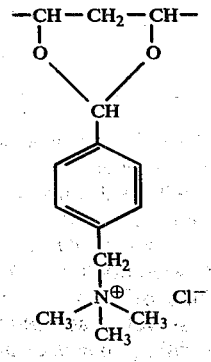

Acetal of polyvinyl alcohol and N(p-formyl benzyl) N,N,N-trimethyl ammonium chloride.

FORMULA E

In both film units, the acetal comprised 100% of the image-receiving layer material. Exposure, processing and density measurements were done as in previous Examples and Table 7 summarizes the results.

TABLE 7

| FILM UNIT | D-MAX RED | D-MAX GREEN | D-MAX BLUE |
|---|---|---|---|
| SC6832 | 2.02 | 1.50 | 1.74 |
| SC6846 | 2.45 | 2.33 | 2.27 |

The acetals of polyvinyl alcohol of the image-receiving layers of Film Units SC6832 and SC6846 are very similar in structure. The acetal of the receiving layer of Film Unit SC6832 being the acetal of polyvinyl alcohol and the N(p-formylphenyl)trimethyl ammonium salt while the image-receiving of Film Unit SC6846 comprises the acetal of polyvinyl alcohol and the N(p-formyl benzyl)trimethyl ammonium salt. Moreover, the degree of acetalization of each acetal is substantially the same, (34.2% for the acetal of Film Unit SC6832 and 30% for the acetal of Film Unit SC6846). Accordingly this Example provides a direct comparison between an acetal of the prior art and the acetal of the present invention which is most closely related to it. However, Table 7 clearly evidences that the D-max values obtained with image-receiving layers comprising the acetals of this invention are significantly superior to even the most closely related acetal of the prior art.

EXAMPLE 11

In this Example, density measurements of Film Unit SC6833 (Prior Art) (Example 8) are compared with density measurements of a film unit having an image-receiving layer comprising a 1:1 mixture of polyvinyl alcohol and the acetal of Formula E. Accordingly the image-receiving layer of Film Unit SC6847 of Table 8 below comprised a 1:1 mixture of polyvinyl alcohol and N(p-formyl benzyl)trimethyl ammonium chloride (degree of acetalization about 30%). Exposure, processing and density measurements were done as in the previous Examples and Table 8 summarizes the results.

TABLE 8

| FILM UNIT | D-MAX RED | D-MAX GREEN | D-MAX BLUE |
|---|---|---|---|
| SC6833 (Prior Art) | 2.44 | 1.54 | 1.58 |
| SC6847 | 2.12 | 1.98 | 1.90 |

Again, a desirably high Red D-max value is obtained for both film units but Film Unit SC6847 presents significantly improved Green and Blue D-max values and an improved overall balance of high densities for each color.

From the foregoing description it should be apparent that the essence of this invention resides in the discovery that acetals of hydroxylated polymers and formyl benzyl quaternary ammonium salts are particularly effective as mordants for photographic dyes and provide special advantages when used as materials of fabrication for receiving layers for such dyes. Accordingly many changes may be made in details of the above Examples offered for the purposes of illustrating preferred embodiments of the invention without departing from the spirit and scope of the invention defined in the appended claims.

What is claimed is:

1. A diffusion transfer film unit which comprises a photosensitive system carried by a support and including at least one silver halide emulsion layer associated with a diffusion transfer process dye image-providing material and an image-receiving layer carried by a support and adapted to receive said dye image-providing material after photo-exposure and processing, said image-receiving layer comprising an acetal of a polyvinyl-alcohol and a formyl benzyl quaternary ammonium salt of the formula:

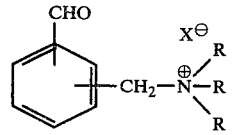

where each R is the same or different aliphatic substituent and X is an anion.

2. A diffusion transfer film unit of claim 1 which comprises a photosensitive element which includes a support carrying said photosensitive system, an image-receiving element which can be superposed on said photosensitive element after photoexposure and which includes a support carrying said image-receiving layer and means retaining a diffusion transfer processing composition integrated with said elements so that said processing composition can be distributed between the superposed elements after photoexposure of the photosensitive element.

3. A diffusion transfer film unit of claim 1 where said unit is an integral negative-positive film unit which comprises said photosensitive system, said image-receiving layer and a light-reflecting layer against which a dye image in said image-receiving layer can be viewed, said light-reflecting layer being positioned between said image-receiving layer and said photosensitive system before or after photoexposure of the film unit.

4. A diffusion transfer film unit of claim 1 where said acetal comprises from about 10 to about 100 percent of the image-receiving layer material.

5. A diffusion transfer film unit of claim 1 where said acetal has a degree of acetalization between about 5 to about 40 percent.

6. A diffusion transfer film unit of claim 1 where said image-receiving layer comprises a mixture of said acetal and a hydrophilic polymeric image-receiving layer material.

7. A diffusion transfer film unit of claim 1 where R is the same or different alkyl substituents having from 1 to 6 carbon atoms and at least one R is a carbocyclic substituent.

8. A diffusion transfer film unit of claim 7 where said acetal has a degree of acetalization between about 5 to about 40 percent.

9. A diffusion transfer film unit of claim 7 where said acetal comprises from about 10 to about 100 percent of the image-receiving layer material.

10. A diffusion transfer film unit of claim 7 where said image-receiving layer comprises a mixture of said acetal and a hydrophilic polymeric image-receiving layer material.

11. A diffusion transfer film unit of claim 7 where said image-receiving layer comprises a mixture of said acetal and polyvinyl alcohol.

12. A diffusion transfer film unit of claim 32 where the ratio of said acetal to polyvinyl alcohol is about 1:1.

13. A diffusion transfer film unit of claim 7 where said acetal comprises segments of the formula:

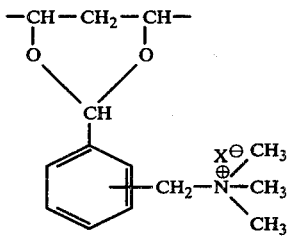

where X is a halogen anion.

14. A diffusion transfer film unit of claim 13 where said acetal has a degree of acetalization between about 5 to about 40 percent.

15. A diffusion transfer film unit of claim 7 where said acetal comprises segments of the formula:

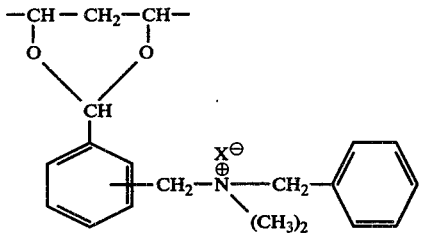

where X is a halogen anion.

16. A diffusion transfer film unit of claim 15 where said acetal has a degree of acetalization between about 5 to about 40 percent.

17. An integral negative-positive diffusion transfer film unit which comprises:

a first sheet-like element comprising an opaque support carrying a plurality of layers including at least one photosensitive silver halide layer associated with a diffusion transfer process dye image-providing material;

a second sheet-like element comprising a transparent support carrying a dye image-receiving layer which comprises an acetal of a polyvinyl alcohol and a formyl benzyl quaternary ammonium salt of the formula:

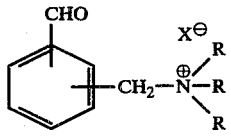

where each R is the same or different aliphatic substituent and X is an anion;

a rupturable container releasably holding an aqueous alkaline, opaque processing composition including a light-reflecting pigment;

said first and second sheet-like elements being held in superposed, fixed relationship, with said supports outermost, during photoexposure and processing, said photosensitive silver halide emulsion layer(s) being exposable through said transparent support;

said rupturable container being positioned transverse said one end of said film unit so as to release said processing composition for distribution between said sheet-like elements after photoexposure to provide a light-reflecting layer and against which a color transfer image formed in said image-receiving layer may be viewed through said transparent support without separation of said superposed first and second sheet-like elements.

18. A diffusion transfer film unit of claim 17 where said opaque processing composition includes at least one optical filter agent which is colored at a pH about the pKa of the filter agent, the concentration of filter agent being effective in combination with said pigment to provide a layer exhibiting optical transmission density of at least about 6.0 density units with respect to incident light actinic to the silver halide emulsion layer and said film unit comprises means for reducing the pH of the unit below the pKa of the optical filter agent so that said agent is substantially colorless after substantial formation of said color image in said image-receiving layer.

19. A diffusion transfer film unit of claim 17 where said acetal comprises from about 10 to about 100 percent of the image-receiving layer material.

20. A diffusion transfer film unit of claim 17 where said acetal has a degree of acetalization between about 5 to about 40 percent.

21. A diffusion transfer film unit of claim 17 where said image-receiving layer comprises a mixture of said acetal and a hydrophilic polymeric image-receiving layer material.

22. A diffusion transfer film unit of claim 17 where each R is the same or different alkyl substituent having from 1 to 6 carbon atoms and at least one R is a carbocyclic substituent.

23. A diffusion transfer film unit of claim 22 where said acetal has a degree of acetalization between about 5 to about 40 percent.

24. A diffusion transfer film unit of claim 22 where said acetal comprises from about 10 to about 100 percent of the image-receiving layer material.

25. A diffusion transfer film unit of claim 22 where said image-receiving layer comprises a mixture of said acetal and a hydrophilic polymeric image-receiving layer material.

26. A diffusion transfer film unit of claim 22 where said image-receiving layer comprises a mixture of said acetal and polyvinyl alcohol.

27. A diffusion transfer film unit of claim 26 where the ratio of said acetal to polyvinyl alcohol is about 1:1.

28. A diffusion transfer film unit of claim 22 where said acetal comprises segments of the formula:

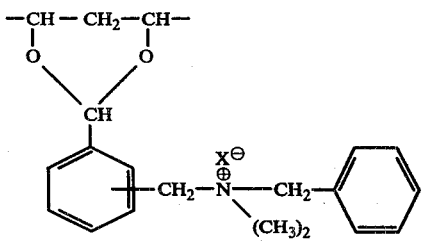

where X is a halogen anion.

29. A diffusion transfer film unit of claim 30 where said acetal has a degree of acetalization between about 5 to about 40 percent.

30. A diffusion transfer film unit of claim 17 where said acetal comprises segments of the formula:

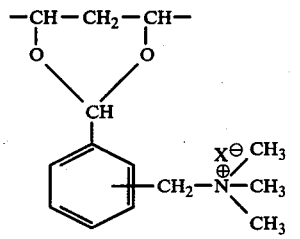

where X is a halogen anion.

31. A diffusion transfer film unit of claim 30 where said acetal has a degree of acetalization between about 5 to about 40 percent.

32. An integral negative-positive diffusion transfer film unit which comprises:

a first sheet-like element comprising a first transparent support;

a second sheet-like element comprising a second transparent support carrying, in sequence, a dye image-receiving layer which comprises an acetal of a polyvinyl alcohol and a formyl benzyl quaternary ammonium salt of the formula:

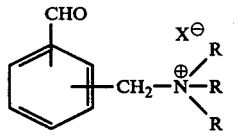

where R is the same or different aliphatic substituents and X is an anion;

a light-reflecting layer and at least one photosensitive silver halide layer associated with a diffusion transfer process dye image-providing material;

a rupturable container releasably holding an aqueous, alkaline, opaque processing composition;

said first and second sheet-like elements being held in superposed, fixed relationship, with said supports outermost, during photoexposure and processing, said photosensitive silver halide emulsion layer(s) being exposable through said first transparent support;

said rupturable container being positioned transverse said one end of said film unit so as to release said processing composition for distribution between said first transparent support and the photosensitive silver halide layer.

33. A diffusion transfer film unit of claim 32 where said acetal comprises from about 10 to about 100 percent of the image-receiving layer material.

34. A diffusion transfer film unit of claim 32 where said acetal has a degree of acetalization between about 5 to about 40 percent.

35. A diffusion transfer film unit of claim 32 where said image-receiving layer comprises a mixture of said acetal and a hydrophilic polymeric image-receiving layer material.

36. A diffusion transfer film unit of claim 32 where each R is the same or different alkyl substituent having from 1 to 6 carbon atoms and at least one R is a carbocyclic substituent.

37. A diffusion transfer film unit of claim 36 where said acetal has a degree of acetalization between about 5 to about 40 percent.

38. A diffusion transfer film unit of claim 36 where said acetal comprises from about 10 to about 100 percent of the image-receiving layer material.

39. A diffusion transfer film unit of claim 36 where said image-receiving layer comprises a mixture of said acetal and a hydrophilic polymeric image-receiving layer material.

40. A diffusion transfer film unit of claim 36 where said image-receiving layer comprises a mixture of said acetal and polyvinyl alcohol.

41. A diffusion transfer film unit of claim 40 where the ratio of said acetal to polyvinyl alcohol is about 1:1.

42. A diffusion transfer film unit of claim 36 where said acetal comprises segments of the formula:

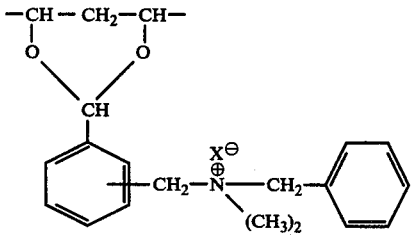

where X is a halogen anion.

43. A diffusion transfer film unit of claim 42 where said acetal has a degree of acetalization between about 5 to about 40 percent.

44. A diffusion transfer film unit of claim 36 where said acetal comprises segments of the formula:

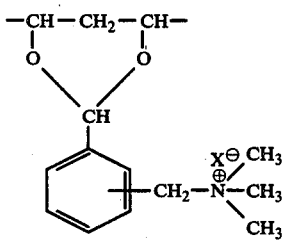

where X is a halogen anion.

45. A diffusion transfer film unit of claim 44 where said acetal has a degree of acetalization between about 5 to about 40 percent.

46. A method for forming a diffusion transfer image which comprises the steps of:

a. photoexposing a photosensitive element of a diffusion transfer film unit, said photosensitive element comprising a silver halide emulsion layer carried by a support and integrated with a diffusion transfer dye image-providing material;

b. developing the photoexposed element by contacting the element with a diffusion transfer processing composition to form an imagewise distribution of diffusible dye image-providing material as a function of development;

c. transferring said imagewise distribution of dye image-providing material to an image-receiving layer carried by a support and in superposed relationship with said photosensitive element where said imagewise distribution is mordanted by a dye image material mordant(s) to provide said diffusion transfer image, said mordant(s) comprising an acetal of a polyvinyl alcohol and a formyl benzyl quaternary ammonium salt of the formula:

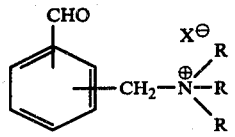

where each R is the same or different aliphatic substituent and X is an anion.

47. A method of claim 46 where said processing composition comprises said mordant.

48. A method of claim 46 where said mordant comprises at least a portion of the material comprising said image-receiving layer.

* * * * *